US008002528B2

(12) United States Patent
Hodapp et al.

(10) Patent No.: US 8,002,528 B2
(45) Date of Patent: Aug. 23, 2011

(54) COMPRESSOR ASSEMBLY HAVING VIBRATION ATTENUATING STRUCTURE

(75) Inventors: Thomas R. Hodapp, Dayton, OH (US); Robert J. Comparin, Camden, OH (US); Parag H. Mathuria, Sidney, OH (US); Daniel L. McSweeney, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 1000 days.

(21) Appl. No.: 11/854,863

(22) Filed: Sep. 13, 2007

(65) Prior Publication Data

US 2008/0219865 A1 Sep. 11, 2008

Related U.S. Application Data

(60) Provisional application No. 60/845,299, filed on Sep. 18, 2006.

(51) Int. Cl.
*F04B 35/00* (2006.01)

(52) U.S. Cl. ..... 417/363; 417/902; 417/410.5; 417/423.14

(58) Field of Classification Search ..... 417/363, 417/410.5, 902, 423.14; 29/888.022; 310/51; 416/500; 418/55.1; 403/195; 248/638, 916, 248/678

See application file for complete search history.

(56) References Cited

U.S. PATENT DOCUMENTS 3,273,670 A * 9/1966 Kleinlein ..... 188/381
4,076,197 A 2/1978 Dochterman
4,917,581 A 4/1990 Richardson, Jr. et al.
4,964,609 A 10/1990 Tomell
5,332,188 A 7/1994 Davis et al.
5,524,860 A 6/1996 Ives
5,696,416 A * 12/1997 Baker et al. ..... 310/91
5,725,931 A * 3/1998 Landin et al. ..... 428/134
5,890,879 A * 4/1999 Rozek ..... 417/363
6,247,909 B1 6/2001 Williams et al.
6,280,155 B1 * 8/2001 Dreiman ..... 417/410.5
6,290,479 B1 9/2001 Friedley et al.
6,375,428 B1 * 4/2002 Stangeland et al. ..... 416/190
6,435,841 B1 * 8/2002 Kim ..... 417/363
6,560,868 B2 5/2003 Milliff et al.
6,648,616 B2 * 11/2003 Patel et al. ..... 417/572
6,659,736 B2 12/2003 Maganhoto et al.
7,281,907 B2 10/2007 Gilliam et al.
2003/0039562 A1 2/2003 Narasipura et al.
2005/0053486 A1 3/2005 Gilliam et al.
2005/0106037 A1 * 5/2005 Kim et al. ..... 417/312
2007/0177994 A1 8/2007 Suh et al.

OTHER PUBLICATIONS

International Preliminary Report on Patentability regarding International Application No. US/PCT/2007/019952 dated Mar. 24, 2009.

* cited by examiner

*Primary Examiner* — Charles G Freay
*Assistant Examiner* — Amene S Bayou
(74) *Attorney, Agent, or Firm* — Harness, Dickey & Pierce, P.L.C.

(57) ABSTRACT

A compressor includes a shell, a compression mechanism, a motor, a base member, and a mounting foot. The compression mechanism is disposed within the shell and the motor is drivingly engaged with the compression mechanism. The base member is coupled to the shell and a mounting foot is fixed to the base member. The mounting foot includes a mounting aperture extending therethrough and a slot intersecting the aperture that attenuates vibrations within an operating frequency range of the compressor.

16 Claims, 4 Drawing Sheets

COMPRESSOR ASSEMBLY HAVING VIBRATION ATTENUATING STRUCTURE

CROSS-REFERENCE TO RELATED APPLICATIONS

This application claims the benefit of U.S. Provisional Application No. 60/845,299, filed on Sep. 18, 2006. The disclosure of the above application is incorporated herein by reference.

FIELD

The present disclosure relates to compressors, and more specifically to noise attenuation mounting structures for compressors.

BACKGROUND

The statements in this section merely provide background information related to the present disclosure and may not constitute prior art.

Operation of a compressor may result in noise generation from moving parts associated therewith, such as the motor and compression mechanism. Compressor noise may be transmitted through the air and/or to a structure engaged with the compressor. The structure of the compressor including the shell and mounting portions may contribute to noise generation by transmitting the noise generated by the moving parts and even amplifying the noise.

SUMMARY

A compressor may include a shell, a compression mechanism, a motor, a base member, and a mounting foot. The compression mechanism may be disposed within the shell and the motor may be drivingly engaged with the compression mechanism. The base member may be coupled to the shell and a mounting foot may be fixed to the base member. The mounting foot may include a mounting aperture extending therethrough and a slot intersecting said aperture that attenuates vibrations within an operating frequency range of the compressor.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
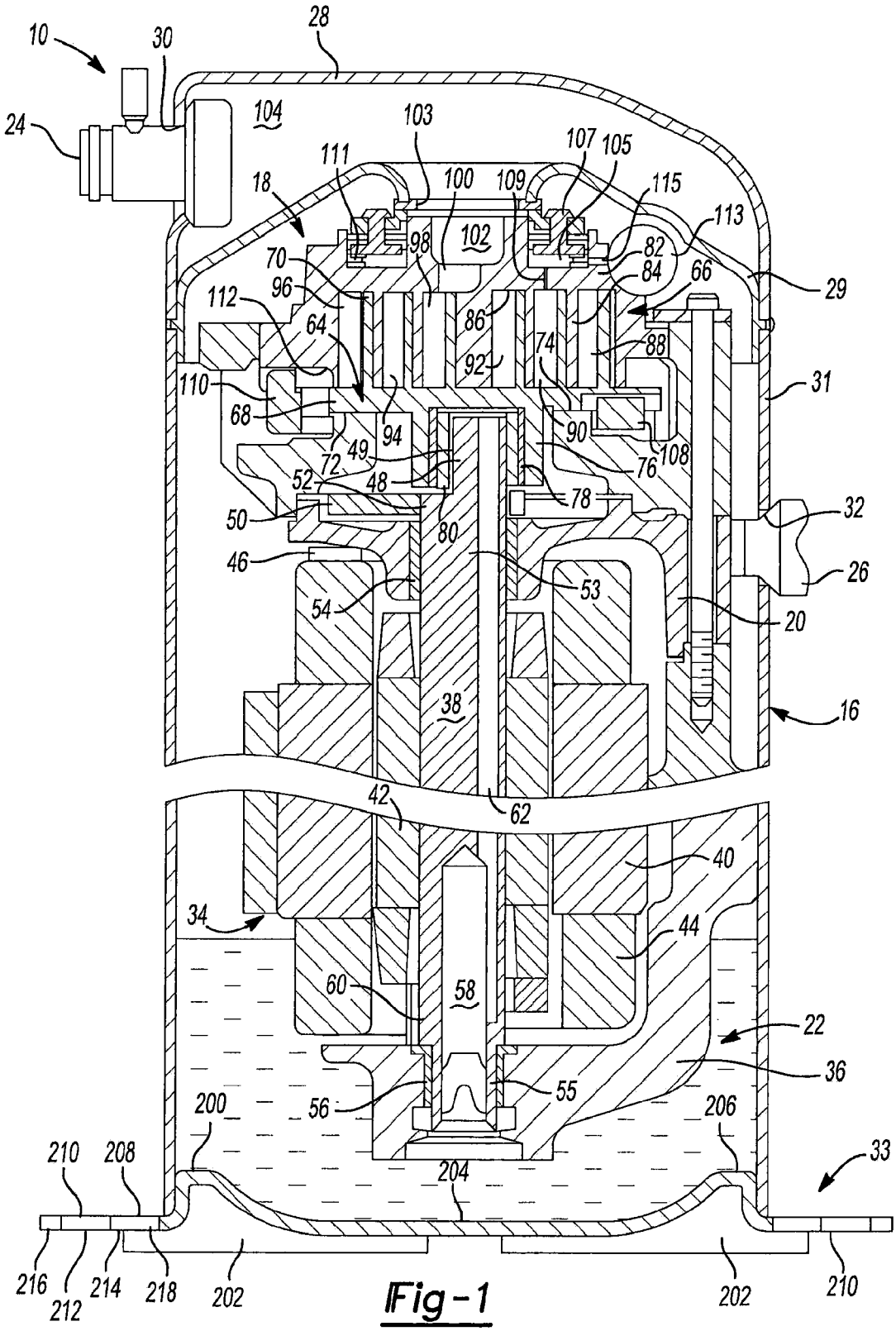
FIG. 1 is a sectional view of a compressor according to the present disclosure.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

Compressor 10 may include a cylindrical hermetic shell 16, a compression mechanism 18, a main bearing housing 20, a motor assembly 22, a refrigerant discharge fitting 24, and a suction gas inlet fitting 26. The hermetic shell 16 may house the compression mechanism 18, main bearing housing 20, and motor assembly 22. Shell 16 may include an end cap 28 at the upper end thereof, a transversely extending partition 29, a longitudinally extending intermediate portion 31, and a lower cover 33. The portions of shell 16 may be fixed to one another in a variety of ways, such as welding, to seal hermetic shell 16. The refrigerant discharge fitting 24 may be attached to shell 16 at opening 30 in end cap 28. The suction gas inlet fitting 26 may be attached to shell 16 at opening 32. The compression mechanism 18 may be driven by motor assembly 22 and supported by main bearing housing 20. The main bearing housing 20 may be affixed to shell 16 at a plurality of points in any desirable manner.

The motor assembly 22 may generally include a motor 34, a frame 36 and a drive shaft 38. The motor 34 may include a motor stator 40 and a rotor 42. The motor stator 40 may be press fit into frame 36, which may in turn be press fit into shell 16. Drive shaft 38 may be rotatably driven by stator 40. Windings 44 may pass through stator 40. Rotor 42 may be press fit on drive shaft 38. A motor protector 46 may be provided in close proximity to windings 44 so that motor protector 46 will de-energize motor 34 if windings 44 exceed their normal temperature range.

Drive shaft 38 may include an eccentric crank pin 48 having a flat 49 thereon and one or more counter-weights 50 at an upper end 52. Drive shaft 38 may include a first bearing portion 53 rotatably journaled in a first bearing 54 in main bearing housing 20 and a second bearing portion 55 rotatably journaled in a second bearing 56 in frame 36. Drive shaft 38 may include an oil-pumping concentric bore 58 at a lower end 60. Concentric bore 58 may communicate with a radially outwardly inclined and relatively smaller diameter bore 62 extending to the upper end 52 of drive shaft 38. The lower interior portion of shell 16 may be filled with lubricating oil. Concentric bore 58 may provide pump action in conjunction with bore 62 to distribute lubricating fluid to various portions of compressor 10.

Compression mechanism 18 may generally include an orbiting scroll 64 and a non-orbiting scroll 66. Orbiting scroll 64 may include an end plate 68 having a spiral vane or wrap 70 on the upper surface thereof and an annular flat thrust surface 72 on the lower surface. Thrust surface 72 may interface with an annular flat thrust bearing surface 74 on an upper surface of main bearing housing 20. A cylindrical hub 76 may project downwardly from thrust surface 72 and may include a journal bearing 78 having a drive bushing 80 rotatively disposed therein. Drive bushing 80 may include an inner bore in which crank pin 48 is drivingly disposed. Crank pin flat 49 may drivingly engage a flat surface in a portion of the inner bore of drive bushing 80 to provide a radially compliant driving arrangement.

Non-orbiting scroll 66 may include an end plate 82 having a spiral wrap 84 on lower surface 86 thereof. Spiral wrap 84 may form a meshing engagement with wrap 70 of orbiting scroll 64, thereby creating an inlet pocket 88, intermediate pockets 90, 92, 94, 96, and outlet pocket 98. Non-orbiting scroll 66 may have a centrally disposed discharge passageway 100 in communication with outlet pocket 98 and upwardly open recess 102 which may be in fluid communication via an opening 103 in partition 29 with a discharge muffler chamber 104 defined by end cap 28 and partition 29.

Non-orbiting scroll 66 may have in the upper surface thereof an annular recess 105 having parallel coaxial side walls in which is sealingly disposed for relative axial movement an annular floating seal 107 which serves to isolate the bottom of recess 105 from the presence of gas under suction and discharge pressure so that it can be placed in fluid communication with a source of intermediate fluid pressure by means of a passageway 109. A spring 111 may urge floating seal 107 upward to maintain a sealing engagement. Non-orbiting scroll 66 may, therefore, be axially biased against orbiting scroll 64 by the forces created by discharge pressure acting on the central portion of scroll 66 and those created by intermediate fluid pressure acting on the bottom of recess 105.

Compressor 10 may use a dual pressure balancing scheme to axially balance non-orbiting scroll 66 with floating seal 107 being used to separate the discharge gas pressure from the suction gas pressure. A solenoid valve 113 may be used to open and close a passageway 115 located within non-orbiting scroll 66. Passageway 115 extends from the bottom of recess 105 which is at intermediate pressure during operation of compressor 10 to the area of compressor 10 which contains suction gas at suction gas pressure.

Relative rotation of the scroll members 64, 66 may be prevented by an Oldham coupling, which may generally include a ring 108 having a first pair of keys 110 (one of which is shown) slidably disposed in diametrically opposed slots 112 (one of which is shown) in non-orbiting scroll 66 and a second pair of keys (not shown) slidably disposed in diametrically opposed slots in orbiting scroll 64.

Figure 2:
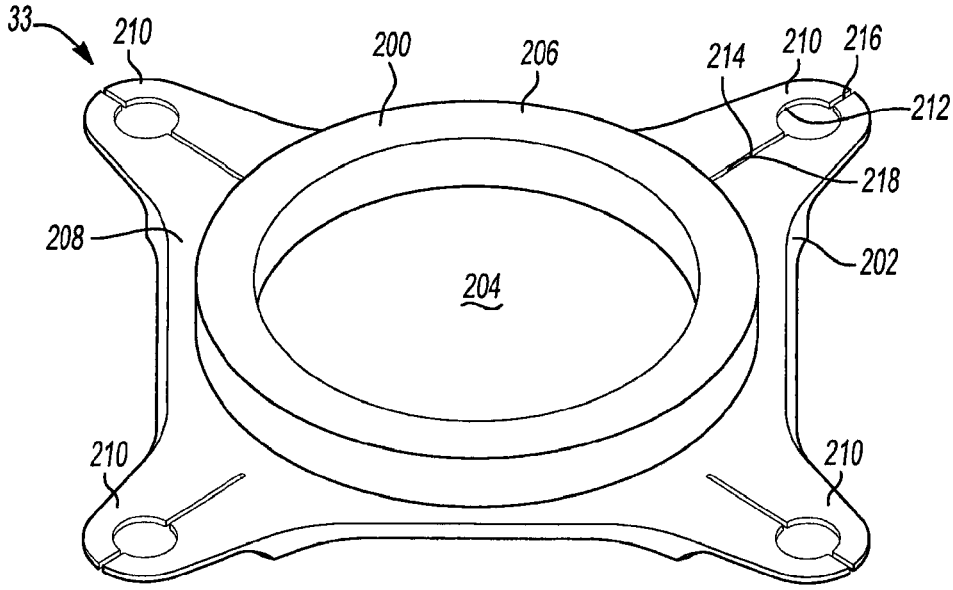
FIG. 2 is a perspective view of a base member of the compressor of FIG. 1.

With additional reference to FIG. 2, lower cover 33 may include an upper portion 200 having a skirt 202 extending from a perimeter thereof. Skirt 202 may extend at an angle relative to upper portion 200. In the present example, skirt 202 extends at an angle of approximately 90 degrees relative to upper portion 200. Upper portion 200 may include a central recessed portion 204 surrounded by a vertically extending annular ridge 206 having a flange portion 208 extending radially outwardly therefrom. Flange portion 208 may have a generally planar body extending generally perpendicular to shell intermediate portion 31. Upper portion 200 may further include a plurality of mounting feet 210 extending radially outwardly from flange portion 208. Mounting feet 210 may include apertures 212 therethrough for securing lower cover 33, and therefore compressor 10, to a base (discussed below).

Upper portion 200 may include a plurality of slots 214 therethrough. Slots 214 may be disposed symmetrically about upper portion 200. Slots 214 may extend radially outwardly relative to central recessed portion 204 and may extend to the perimeter of upper portion 200. More specifically, slots 214 may intersect apertures 212 in mounting feet 210. A first portion 216 of slot 214 may extend from aperture 212 to the perimeter of upper portion 200 and a second portion 218 of slot 214 may extend from aperture 212 radially inwardly toward central recessed portion 204.

Slots 214 may have a width up to the diameter of aperture 212. Slots 214 may shift lower cover natural frequencies away from undesirable frequencies. For example, slots 214 may reduce 800 Hz ⅓ octave band sound levels. Slots 214 may extend along a majority of mounting feet 210. More specifically, slots 214 may extend up to the entire distance between an outer perimeter of a mounting foot 210 to intermediate portion 31 of shell 16.

Figure 3:
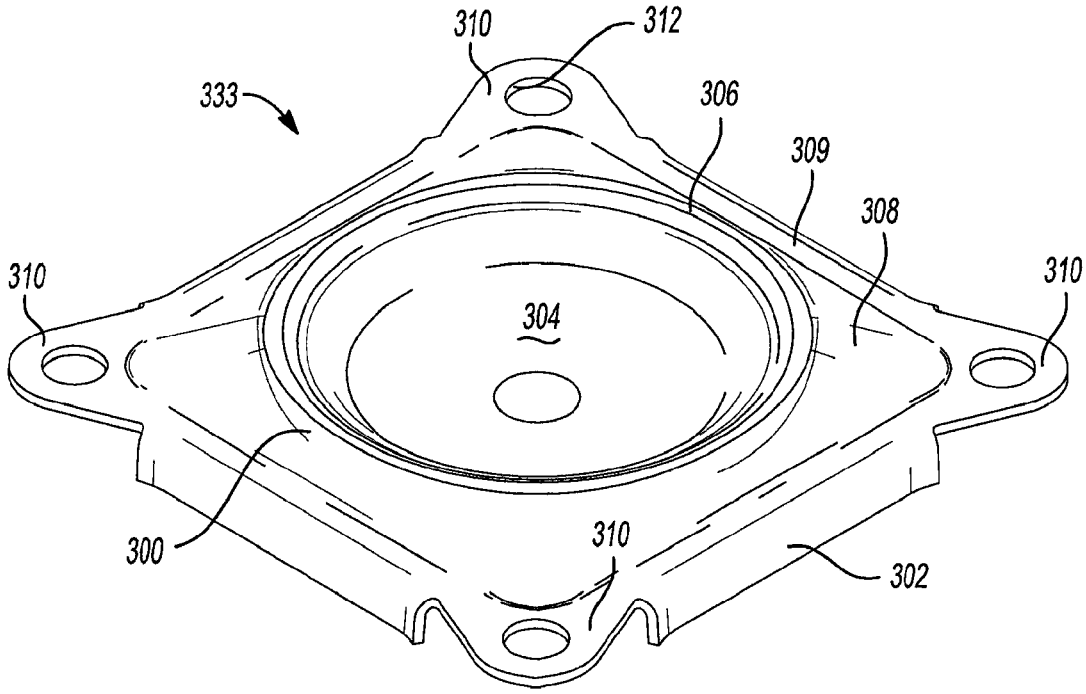
FIG. 3 is a alternate base member according to the present disclosure.
Figure 4:
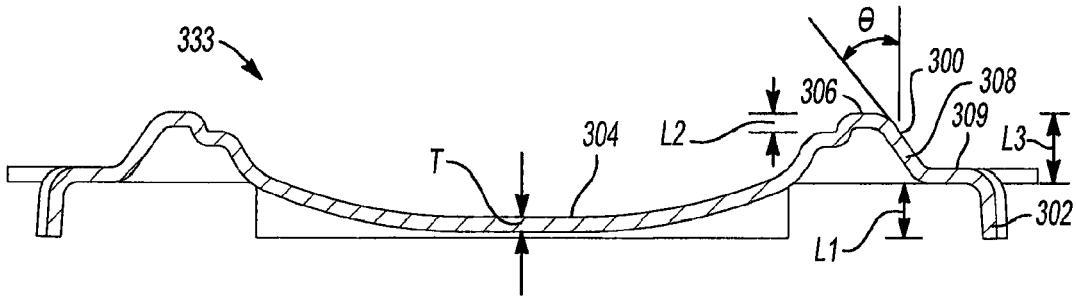
FIG. 4 is a sectional view of the base member of FIG. 3.

An alternate lower cover 333 is shown in FIGS. 3 and 4. Lower cover 333 may include an upper portion 300 having a skirt 302 extending from a perimeter thereof. Skirt 302 may extend at an angle relative to upper portion 300 and may extend a length (L1) of between 3 and 5 times a material thickness (T) of lower cover 333. Upper portion 300 may include a central recessed portion 304 surrounded by a vertically extending annular ridge 306 having a first flange portion 308 extending radially outwardly therefrom. Vertically extending annular ridge 306 may have a height (L2) greater than material thickness (T). Flange portion 308 may have a generally sloped body extending at an angle (θ) of between 20 and 60 degrees relative to annular ridge 306. First flange portion 308 may extend a distance (L3) of between 2 and 6 times material thickness (T) above skirt 302. A second flange portion 309 may extend from and generally surround first flange portion 308. Second flange portion 309 may be generally planar and may have a plurality of mounting feet 310 extending radially outwardly therefrom. Mounting feet 310 may include apertures 312 therethrough for securing lower cover 333 to a base (discussed below).

Lower cover 333 may have a generally square shape with both first and second flange portions 308, 309 having generally square perimeters. As seen in FIG. 3, mounting feet 310 may extend from each of the corners of second flange portion 309. As a result of the features mentioned above, lower cover 333 vibration attenuation may be improved. More specifically, these features may push the natural frequency of lower cover 333 higher, as well as changing the mode shape thereof. For example, the sloped profile of flange portion 308 may stiffen mounting feet 310 and raise the natural frequency of lower cover 333 (ex: from 800 Hz to 1250 Hz). The slot geometry discussed below with respect to FIG. 5 may be used to tune the frequency away from the new frequency (1250 Hz).

Figure 5:
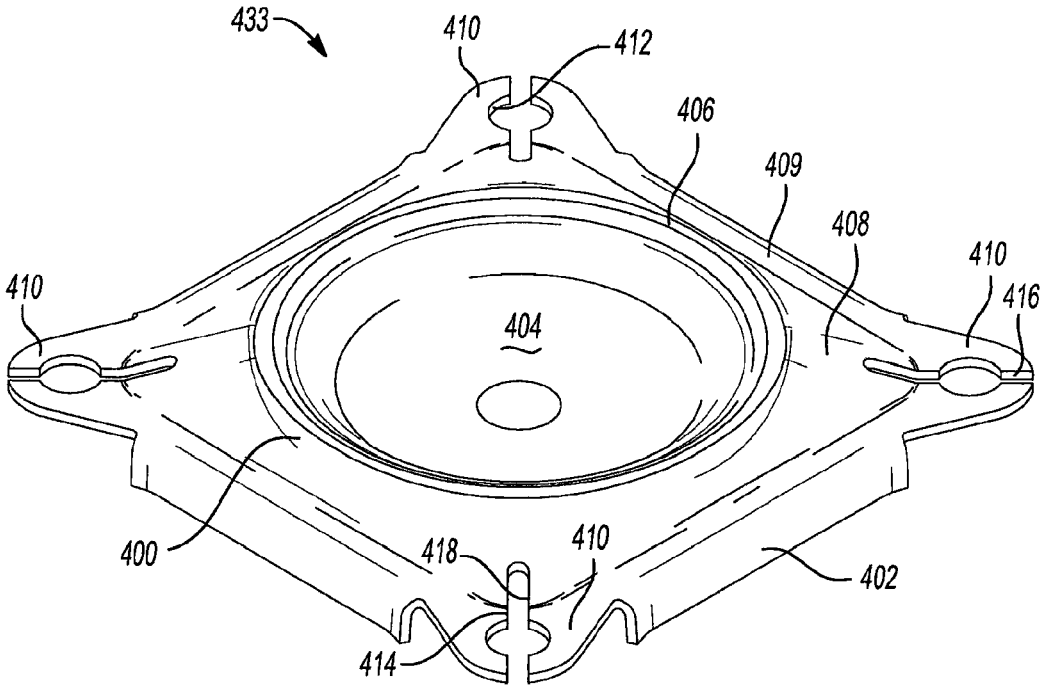
FIG. 5 is an alternate base member according to the present disclosure.

FIG. 5 is an alternate example of a lower cover 433 generally similar to lower cover 333 with the addition of slots 414. As such, the description of lower cover 333 may generally apply to lower cover 433, except as otherwise noted. Lower cover 433 may include an upper portion 400 having a skirt 402 extending from a perimeter thereof.

Skirt 402 may extend at an angle relative to upper portion 400. Skirt 402 may have a length of between 50 and 90 percent of the length of skirt 302. Upper portion 400 may include a central recessed portion 404 surrounded by a vertically extending annular ridge 406 having a first flange portion 408 extending radially outwardly therefrom. Flange portion 408 may have a generally sloped body extending at an angle relative to vertically extending annular ridge 406. Flange portion 408 may have a width of 80 to 110 percent of the width of flange portion 308.

The distance between skirts 402 on opposed sides may be greater than the width of flange portion 408 and 90 to 100 percent of the distance between skirts 302 on opposed sides. A second flange portion 409 may extend from and generally surround first flange portion 408. Second flange portion 409 may be generally planar and may have a plurality of mounting feet 410 extending radially outwardly therefrom. Mounting feet 410 may include apertures 412 therethrough for securing lower cover 433 to a base (discussed below).

Upper portion 400 may include a plurality of slots 414 therethrough. Slots 414 may be disposed symmetrically about upper portion 400. Slots 414 may extend radially outwardly relative to central recessed portion 404 and may extend to the perimeter of upper portion 400. More specifically, slots 414 may intersect apertures 412 in mounting feet 410. A first portion 416 of slot 414 may extend from aperture 412 to the perimeter of upper portion 400 and a second portion 418 of slot 414 may extend from aperture 412 radially inwardly toward central recessed portion 404. Second portion 418 may have a length greater than a material thickness of lower cover 433, similar to material thickness (T) in FIG. 4, and a width generally less than the diameter of aperture 412.

Lower cover 433 may have a generally square shape with both first and second flange portions 408, 409 having generally square perimeters. Mounting feet 410 may extend from each of the corners of second flange portion 409. As a result of the features mentioned above, lower cover 433 vibration attenuation may be improved. More specifically, these features may push the natural frequency of lower cover 433 higher, as well as changing the mode shape thereof. For example, the sloped profile of flange portion 408 may stiffen mounting feet 410 and raise the natural frequency of lower cover 433 (ex: from 800 Hz to 1250 Hz). The slot geometry may be used to tune the frequency of lower cover 433 away from the new frequency (1250 Hz). The features of lower covers 33, 333, 433 may be used in any combination to achieve a desired noise attenuation.

Figure 6:
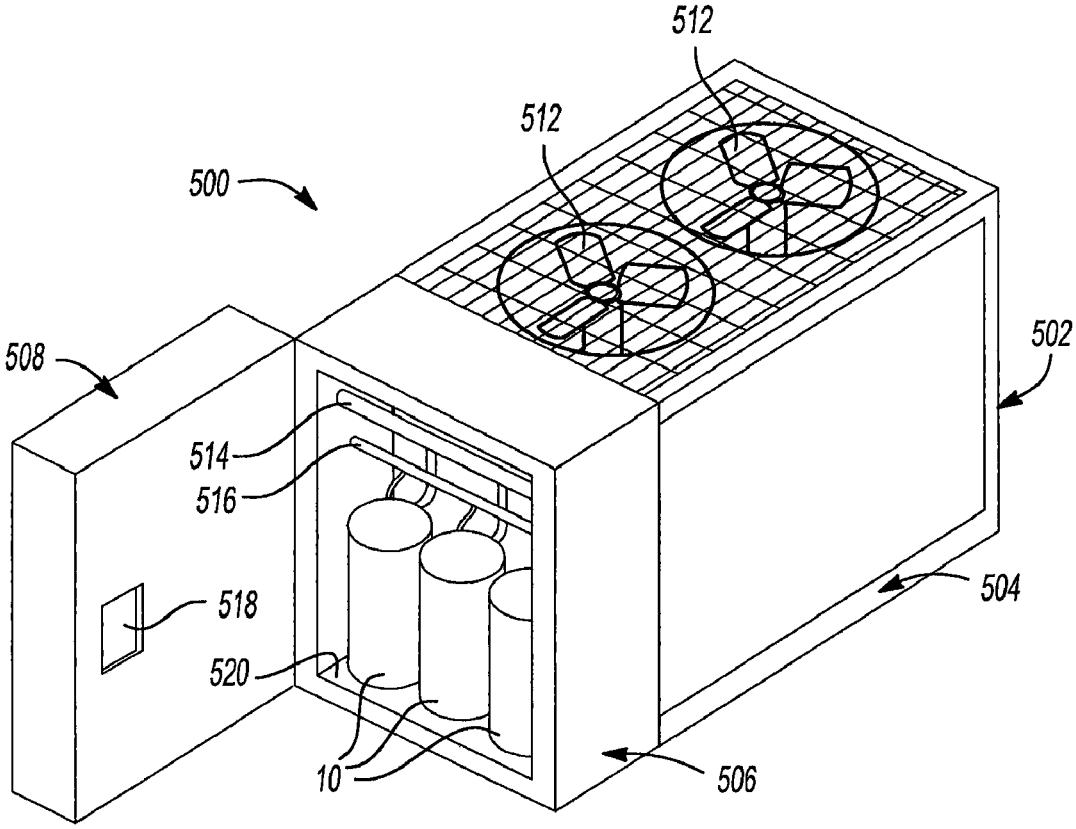
FIG. 6 is a refrigeration unit according to the present disclosure.

As seen in FIG. 6, compressor 10 may be part of a refrigeration unit 500. Refrigeration unit 500 may include a housing 502 divided into a condensing unit cabinet 504, a compressor cabinet 506, and an electronic cabinet 508. Condensing unit cabinet 504 may house a condensing unit (not shown) and condenser fans 512. Compressor cabinet 506 may house one or more compressors 10, as well as a suction header 514 and a discharge header 516. Electronic cabinet 508 may enclose a controller 518 in an enclosure accessible from the exterior of housing 502.

Compressor 10 may be mounted to a base pan 520 of housing 502 at feet 210. Sound may be generated from two sources, compressor 10 (air-borne and structure-borne noise) and base pan 520, or other support structure (structure-borne noise). The pattern of sound generation may be modified by shifting natural frequencies and modifying mode shapes of mounting feet 210 and/or lower cover 33. This modification may be achieved in a variety of ways. For example, lower cover 33 may be designed in a way such that the natural modes of mounting feet 210 do not match any local or global mode of base pan 520 or any other mounting structures. It is understood that the above description applies equally to lower covers 333, 433.

Base pan 520 may include puck-like protrusions, or grommets, (not shown) for engagement with compressor feet 210. Mounting feet 210 may be bolted to base pan 520 at the grommets. Double studded grommets may lower natural frequencies, while conventional mounting may increase natural frequencies through increased torque on the bolt when mounting lower cover 33 to base pan 520 or other support structure. The presence of any slots, windows or slits may change the boundary conditions of the cavity beneath lower cover 33, which in turn may change the noise radiation pattern when compressor 10 is mounted to base pan 520, or some other mounting structure. While described with respect to lower cover 33, it is understood that the description of the engagement between lower cover 33 and base pan 520 applies equally to lower covers 333, 433.

By way of example, internal components of compressor 10 may have 800 Hz ⅓ Octave and 1250 Hz ⅓ Octave natural frequencies. These frequencies may be passed through lower cover 33 and amplified. Using the features described above, the natural frequencies of lower cover 33 may be mismatched relative to the natural frequencies of the internal components of compressor 10 to break the chain of energy.

What is claimed is:

1. A compressor comprising:
a shell;
a compression mechanism within said shell;
a motor driving said compression mechanism;
a base member coupled to said shell; and
a mounting foot fixed to said base member and including a mounting aperture extending therethrough and a slot intersecting said aperture that attenuates vibrations within an operating frequency range of the compressor, said slot extending both radially inwardly and radially outwardly relative to said aperture and extending through an outer perimeter of said base member.

2. The compressor of claim 1, wherein said radially inwardly extending slot has a width that is less than a diameter of said aperture.

3. The compressor of claim 1, wherein said slot defines a radial length radially inwardly relative to said aperture that is greater than the material thickness of said base member.

4. The compressor of claim 1, wherein said base member includes first and second portions, said first portion and said shell defining a chamber housing said compression mechanism therein, said first portion defining a lower portion of said chamber and said second portion extending radially outwardly therefrom and having said slot disposed therein.

5. The compressor of claim 4, wherein said second portion includes a generally planar portion and an angularly extending portion, said angularly extending portion disposed between and extending at a generally downward slope from said first portion to said generally planar portion.

6. The compressor of claim 5, wherein said aperture is disposed in said planar portion.

7. The compressor of claim 6, wherein said slot extends into said angularly extending portion.

8. The compressor of claim 5, wherein said planar portion defines an outer perimeter of said base member.

9. The compressor of claim 8, wherein said base member includes a skirt extending from an outer perimeter of said base member in a direction axially outwardly from said shell.

10. The compressor of claim 9, wherein said skirt includes an axial dimension that is between 3 and 5 times the material thickness of said base member.

11. The compressor of claim 5, wherein said angularly extending portion is disposed at an angle between 20 and 60 degrees relative to a longitudinal axis of said compressor.

12. The compressor of claim 11, wherein said angularly extending portion includes an axial dimention that is between 2 and 6 times the material thickness of said base member.

13. The compressor of claim 4, wherein said first portion includes a generally concave portion forming an end of said chamber.

14. The compressor of claim 1, wherein said base member and said shell define a chamber containing said compression mechanism.

15. The compressor of claim 1, wherein said motor is disposed within said shell.

16. The compressor of claim 1, wherein said compression mechanism is disposed in a suction pressure region of said shell.

* * * * *

UNITED STATES PATENT AND TRADEMARK OFFICE

CERTIFICATE OF CORRECTION

PATENT NO. : 8,002,528 B2
APPLICATION NO. : 11/854863
DATED : August 23, 2011
INVENTOR(S) : Thomas R. Hodapp et al.

It is certified that error appears in the above-identified patent and that said Letters Patent is hereby corrected as shown below:

| | |
|---|---|
| Col. 1, Line 61 | "a alternate" should be --an alternate-- |
| Col. 6, Line 52 | "dimention" should be --dimension-- |

Signed and Sealed this
Twentieth Day of December, 2011

David J. Kappos

David J. Kappos
*Director of the United States Patent and Trademark Office*